US006630889B1

(12) United States Patent
Morikawa

(10) Patent No.: US 6,630,889 B1
(45) Date of Patent: Oct. 7, 2003

(54) SECURITY LOCK CONTROL METHOD FOR REMOTE CONTROL SYSTEM

(75) Inventor: Shigekazu Morikawa, Hirakata (JP)

(73) Assignee: Sanyo Electric Co., Ltd., Osaka (JP)

( * ) Notice: Subject to any disclaimer, the term of this patent is extended or adjusted under 35 U.S.C. 154(b) by 631 days.

(21) Appl. No.: 09/599,253

(22) Filed: Jun. 23, 2000

(30) Foreign Application Priority Data

Jun. 25, 1999 (JP) ..... 11-180315

(51) Int. Cl.[7] ..... G08C 19/00

(52) U.S. Cl. ..... 340/825.72; 340/825.69; 340/825.5; 340/825.51; 340/825.52; 340/825.25; 340/3.42; 455/151.4; 348/734; 709/217

(58) Field of Search ..... 340/825.72, 825.69, 340/825.5, 825.51, 825.52, 3.42, 825.25; 348/734; 455/151.4; 709/217, 218, 219, 208, 209, 210; 710/100, 110

(56) References Cited

U.S. PATENT DOCUMENTS 5,488,357 A * 1/1996 Sato et al. ..... 340/825.25
5,736,931 A * 4/1998 Sato et al. ..... 340/825.25

* cited by examiner

*Primary Examiner*—Michael Horabik
*Assistant Examiner*—Yves Dalencourt
(74) *Attorney, Agent, or Firm*—Arent Fox Kintner Plotkin & Kahn

(57) ABSTRACT

When an operation is performed to set a subcontroller in remote-control enable mode, the subcontroller first checks the operation mode of a main controller, then setting itself in the remote-control enable mode if the main controller is in the remote-control enable mode, or maintaining itself in remote-control disable mode if the main controller is in the remote-control disable mode.

4 Claims, 6 Drawing Sheets

SECURITY LOCK CONTROL METHOD FOR REMOTE CONTROL SYSTEM

BACKGROUND OF THE INVENTION

The present invention relates to a security lock control method for remote control system.

PRIOR ART

There has been known to the art a security system having a plurality of security devices interconnected via, for example, a communication control wire (bus) complying with a standard such as RS-485 (EIA-485 Standards). Examples of the security device include a surveillance camera, VTR for recording images picked up by the surveillance camera, frame switcher and the like. Each of the security devices is assigned a specific address for discrimination from the other security devices on the bus. The address setting is done, for example, by means of a DIP switch assembly provided at each security device.

The bus with the security devices connected thereto is connected to a controller for remote control of the security devices or for centralized management of conditions of the security devices. For instance, a remote control of a VTR having address "1" is done by transmitting a command containing the address "1" of the VTR and a control content such as "PLAY" or "EJECT".

The controller is also adapted to transmit a control command to all the security devices on the bus at a time. Such a transmission method is known as broadcast transmission. Such a control through broadcast transmission is performed for setting the respective clocks of all the security devices on the bus to the same time of day, for example.

The security system must ensure the prevention of any unauthorized attempt to deactivate any of the security devices performing operations for security purposes. In this connection, some security systems support a controller setting such that the controller can disable the remote control of all the security devices on the bus which are performing the operations for security purposes (activate security lock).

Some security systems are configured to permit connection of plural controllers for remote control from different rooms. The security system configured to permit the connection of plural controllers involves fear that even though a main controller activates the security lock, the security lock may be deactivated by another controller.

To prevent the security lock from being released by another controller, it may be contemplated to set the bus in Busy state by means of the main controller thereby disabling the bus line itself. However, this also disables the controller to obtain useful information from the security devices on the bus.

The useful information includes, for example, alarm information supplied to the controller from the respective devices. Some of the security devices has a function to detect a possibility of occurrence of significant event in terms of security. Upon detection of a possible occurrence of the significant event in terms of security, such a security device transmits alarm information to the controller via a communications control line. Receiving the alarm information from the security device, the controller stores the alarm information in a non-volatile memory such as EEPROM.

SUMMARY OF THE INVENTION

It is therefore, an object of the invention to provide a security lock control method for remote control system arranged such that when the main controller is set in remote-control disable mode, communications over the bus are permitted but the electronic devices on the bus are prevented from being remotely controlled through manipulation of a subcontroller.

It is another object of the invention to provide a security lock control method for remote control system arranged such that when a higher priority controller is set in the remote-control disable mode, the communications over the bus are permitted but the electronic devices on the bus are prevented from being remotely controlled through manipulation of a lower priority controller.

According to a first aspect of the invention, a security lock control method for remote control system including electronic devices, one main controller connected to the electronic devices via a bus for remotely controlling the electronic devices, and one or more subcontrollers connected to the electronic devices via the bus for remotely controlling the electronic devices is characterized in that operation modes of each controller include a remote-control enable mode to enable the remote control of all the electronic devices connected to the bus, and a remote-control disable mode to disable the remote control of all the electronic devices connected to the bus; that when an operation is performed to set the main controller in the remote-control disable mode, the main controller sets itself in the remote-control disable mode while informing the subcontrollers that the operation mode of the main controller is transferred to the remote-control disable mode, thereby causing the subcontrollers to set themselves in the remote-control disable mode; that when an operation is performed to set the main controller in the remote-control enable mode, the main controller sets itself in the remote-control enable mode while informing the subcontrollers that the operation mode of the main controller is transferred to the remote-control enable mode, thereby causing the subcontrollers to set themselves in the remote-control enable mode; that when an operation is performed to set any one of the subcontrollers in the remote-control disable mode, the subctontroller sets itself in the remote-control disable mode; and that when an operation is performed to set any one of the subcontrollers in the remote-control enable mode, the subcontroller checks the operation mode of the main controller, then setting itself in the remote-control enable mode if the main controller is in the remote-control enable mode or maintaining itself in the remote-control disable mode if the main controller is in the remote-control disable mode.

It is preferred that when energized, the main controller informs the subcontrollers of its operation mode thereby establishing coincidence in the operation mode of the subcontrollers and the main controller, and that when energized, any one of the subcontrollers checks the operation mode of the main controller for establishing coincidence in the operation mode of the subcontroller and the main controller.

According to a second aspect of the invention, a security lock control method for remote control system including electronic devices and a plurality of controllers connected to the electronic devices via a bus for remotely controlling the electronic devices is characterized in that each of the controllers is previously assigned a priority and has operation modes including a remote-control enable mode to enable remote control of all the electronic devices connected to the bus and a remote-control disable mode to disable the remote control of all the electronic devices connected to the bus; that when an operation is performed to set any one of the controllers in the remote-control disable mode, the controller sets itself in the remote-control disable mode while transmitting to the other controllers a first control command containing a priority thereof; that a controller receiving the first control command sets itself in the remote-control disable mode if the priority contained in the first control command is higher than a priority thereof; that when an operation is performed to set a top priority controller in the remote-control enable mode, the top priority controller sets itself in the remote-control enable mode while transmitting to the other controllers a second control command containing the priority thereof; that when an operation is performed to set any one of the controllers other than the top priority controller in the remote-control enable mode, the controller in question checks the operation mode of any controller higher in priority than itself, then setting itself in the remote-control enable mode and transmitting to the other controllers a second control command containing the priority thereof if the higher priority controller is in the remote-control enable model or maintaining itself in the remote-control disable mode if the higher priority controller is in the remote-control disable mode; and that a controller, receiving the second control command, sets itself in the remote-control enable mode if the priority contained in the second control command is higher than a priority thereof.

It is preferred that if the top priority controller, when energized, is in the remote-control disable mode, the top priority controller transmits to the other controllers the first control command containing the priority thereof; that if the top priority controller is in the remote-control enable mode, the top priority controller transmits to the other controllers the second control command containing the priority thereof; and that when energized, any one of the controllers other than the top priority controller determines whether any of controllers higher in priority than itself operates in the remote-control disable mode or not, then setting itself in the remote-control disable mode if any of the controllers higher in priority than itself is in the remote-control disable mode, or setting itself in the remote-control enable mode if none of the controllers higher in priority than itself is in the remote-control disable mode.

DETAILED DESCRIPTION OF PREFERRED EMBODIMENTS

Now, preferred embodiments of the invention will hereinbelow be described with reference to the accompanying drawings.

Figure 1:
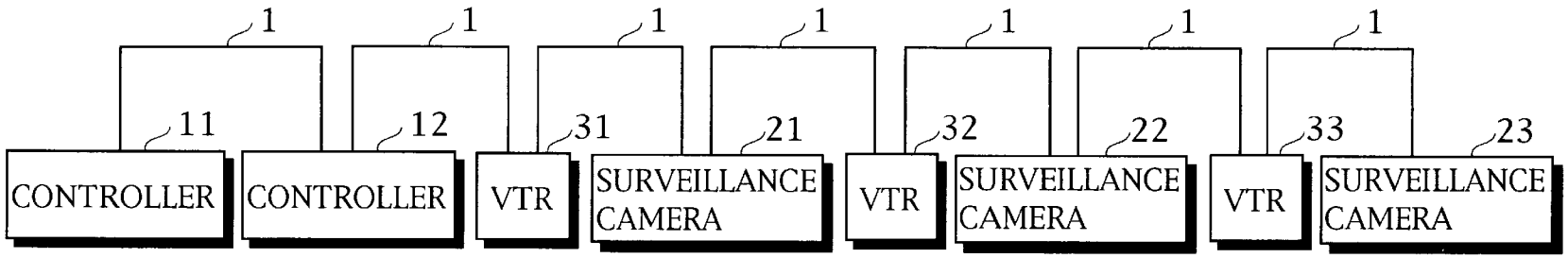
FIG. 1 is a block diagram showing an arrangement of a security system.

FIG. 1 illustrates an arrangement of a security system. The security system includes two controllers 11, 12, three surveillance cameras 21, 22, 23 and three VTRs for recording images picked up by the surveillance cameras 21, 22, 23. These devices are daisy-chained via an RS-485 communications control wire (bus) 1.

Priority assignment is previously set for the controllers 11, 12. The controller 11 is assigned the higher priority than the controller 12. The higher priority controller 11 is herein referred to as "main controller" whereas the lower priority controller 12 is referred to as "subcontroller".

Operation modes of each controller 11, 12 include a remote-control enable mode (Security Lock OFF mode) to enable remote control of all the devices on a bus 1, and a remote-control disable mode (Security Lock ON mode) to disable the remote control of all the devices on the bus 1. Even if an operator enters a control command to the controller set in the remote-control disable mode for remotely controlling a controllable device, the command is nullified. An operation for setting the remote-control enable mode or the remote-control disable mode is performed on each of the controllers 11, 12.

The security system is arranged such that when the main controller 11 of the higher priority is set to operate in the remote-control disable mode, the subcontroller 12 of the lower priority automatically enters the remote-control disable mode, as well. When the main controller 11 of the higher priority is set to operate in the remote-control enable mode, the subcontroller 12 of the lower priority automatically enters the remote-control enable mode, as well.

When the main controller 11 of the higher priority is set in the remote-control disable mode, the subcontroller 12 of the lower priority is inhibited from transferring to the remote-control enable mode.

However, it is possible to set the subcontroller 12 of the lower priority in the remote-control disable mode when the main controller 11 of the higher priority is in the remote-control enable mode.

Figure 2:
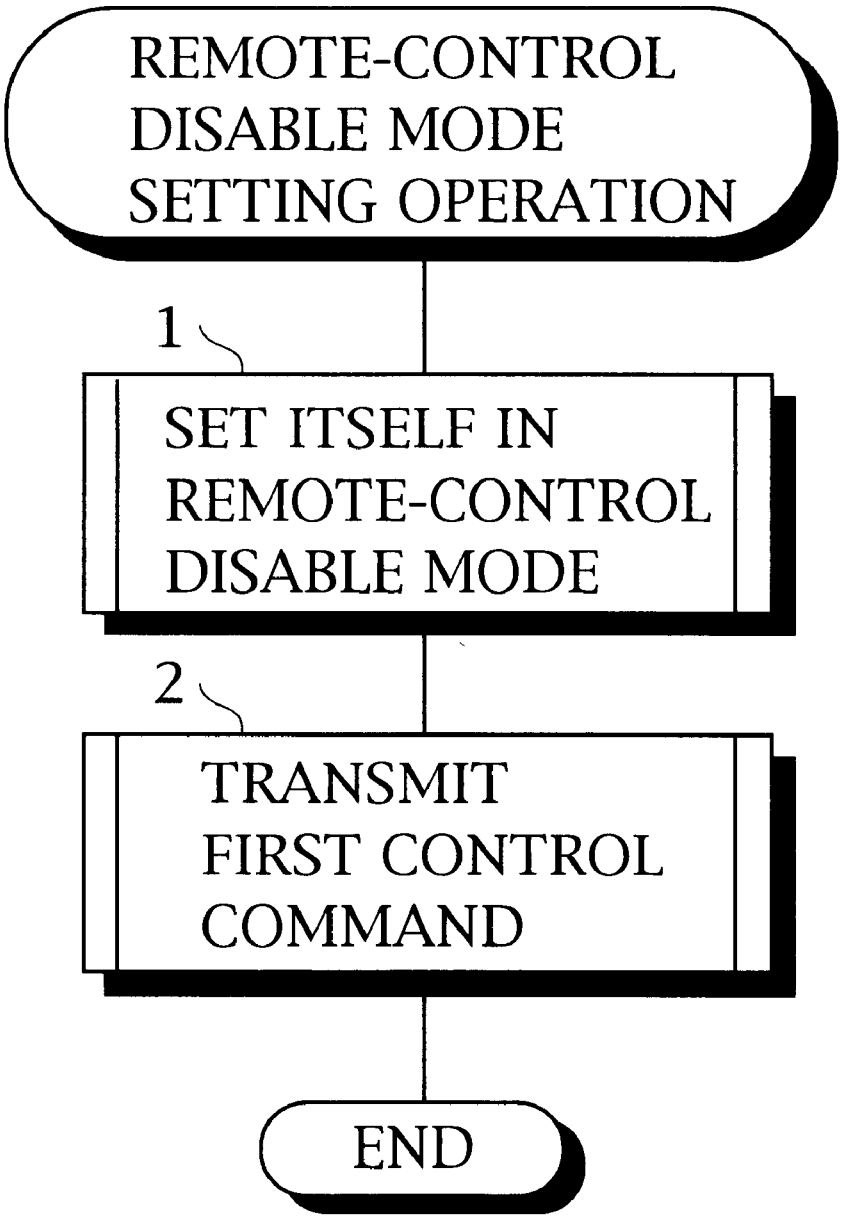
FIG. 2 is a flow chart showing operation steps taken by a controller when an operator manipulates the controller to set it in the remote-control disable mode.

FIG. 2 illustrates operation steps taken by a controller when the operator manipulates the controller to set it in the remote-control disable mode.

When an operation is performed to set an arbitrary controller in the remote-control disable mode, the controller sets itself to operate in the remote-control disable mode (Step 1).

Subsequently, the controller transmits to the other controller a first control command containing its priority.

Figure 3:
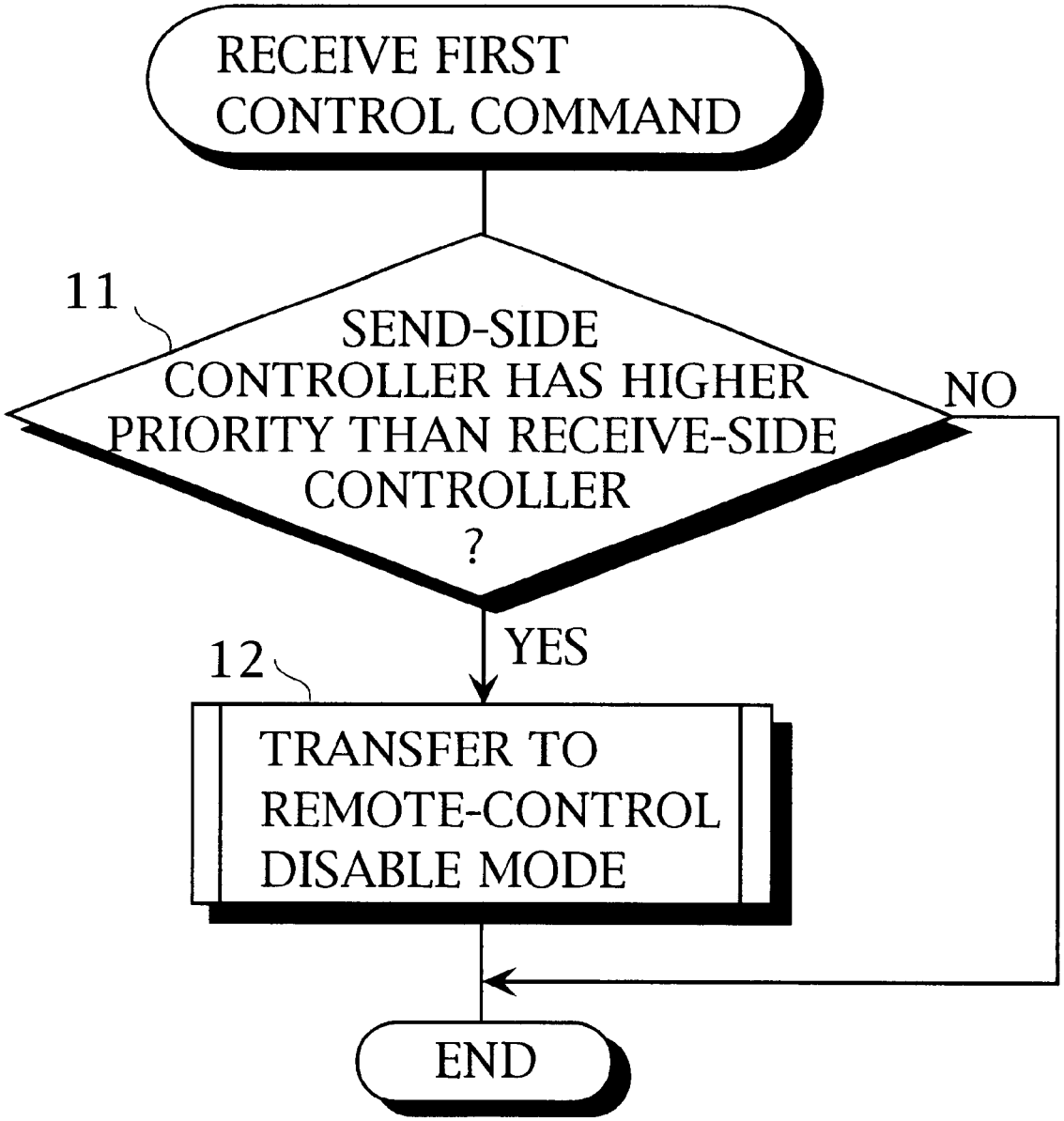
FIG. 3 is a flow chart showing operation steps taken by a controller receiving a first control command from another controller.

FIG. 3 illustrates operation steps taken by a controller receiving the first control command from another controller.

At receipt of the first control command, the receive-side controller determines whether the priority thereof is higher than that of the send-side controller or not (Step 11).

If the priority of the send-side controller is not higher than that of the receive-side controller, the receive-side controller maintains its operation mode as it is.

If the send-side controller is higher in priority than the receive-side controller, the receive-side controller transfers to the remote-control disable mode despite its current operation mode (Step 12).

Accordingly, when the operator manipulates the main controller 11 of the higher priority to set it in the remote-control disable mode, the main controller 11 as well as the subcontroller 12 of the lower priority are transferred to the remote-control disable mode.

Figure 4:
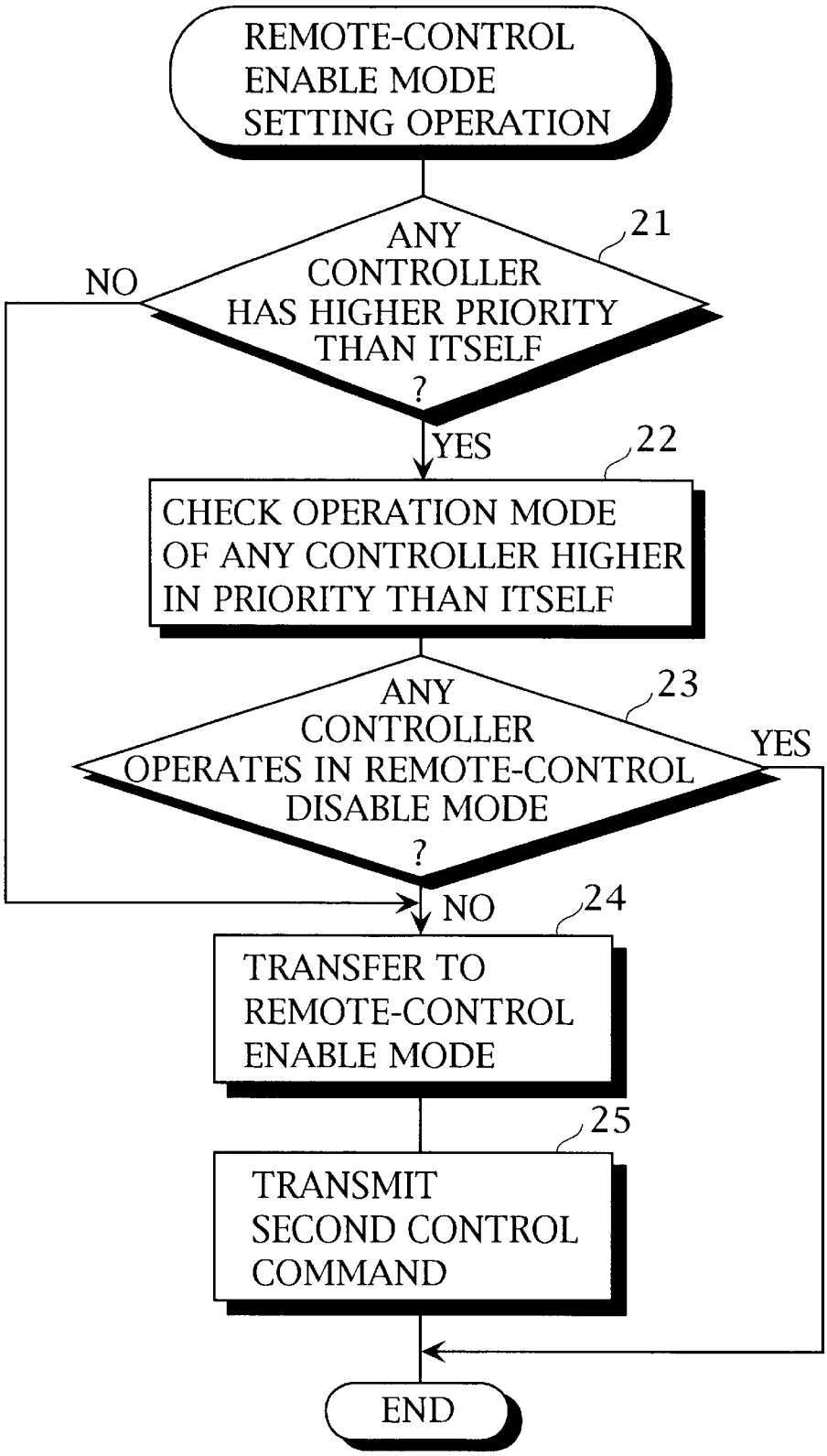
FIG. 4 is a flow chart showing operation steps taken by a controller when the operator manipulates the controller to set it in the remote-control enable mode.

FIG. 4 illustrates operation steps taken by a controller when the operator manipulates the controller to set it in the remote-control enable mode.

When an operation is performed to set an arbitrary controller in the remote-control enable mode, the controller determines whether a controller higher in priority than itself is present or not (Step 21).

If there is any higher priority controller, the controller communicates with such higher priority controllers so as to check current operation modes of the controllers (Step 22). Then the controller determines whether any of such higher priority controllers operates in the remote-control disable mode or not (Step 23).

If the controller determines that any of the higher priority controllers operates in the remote-control disable mode, the controller maintains itself in the remote-control disable mode. That is, if a controller determines that any of the controllers higher in priority than itself operates in the remote-control disable mode, then the controller is inhibited from setting itself in the remote-control enable mode.

If the controller determines at Step 21 that there is no controller higher in priority than itself, or that none of the higher priority controllers operates in the remote-control disable mode, then the controller transfers its operation mode to the remote-control enable mode (Step 24). Subsequently, the controller transmits to the other controllers a second control command containing the priority thereof (Step 25).

Figure 5:
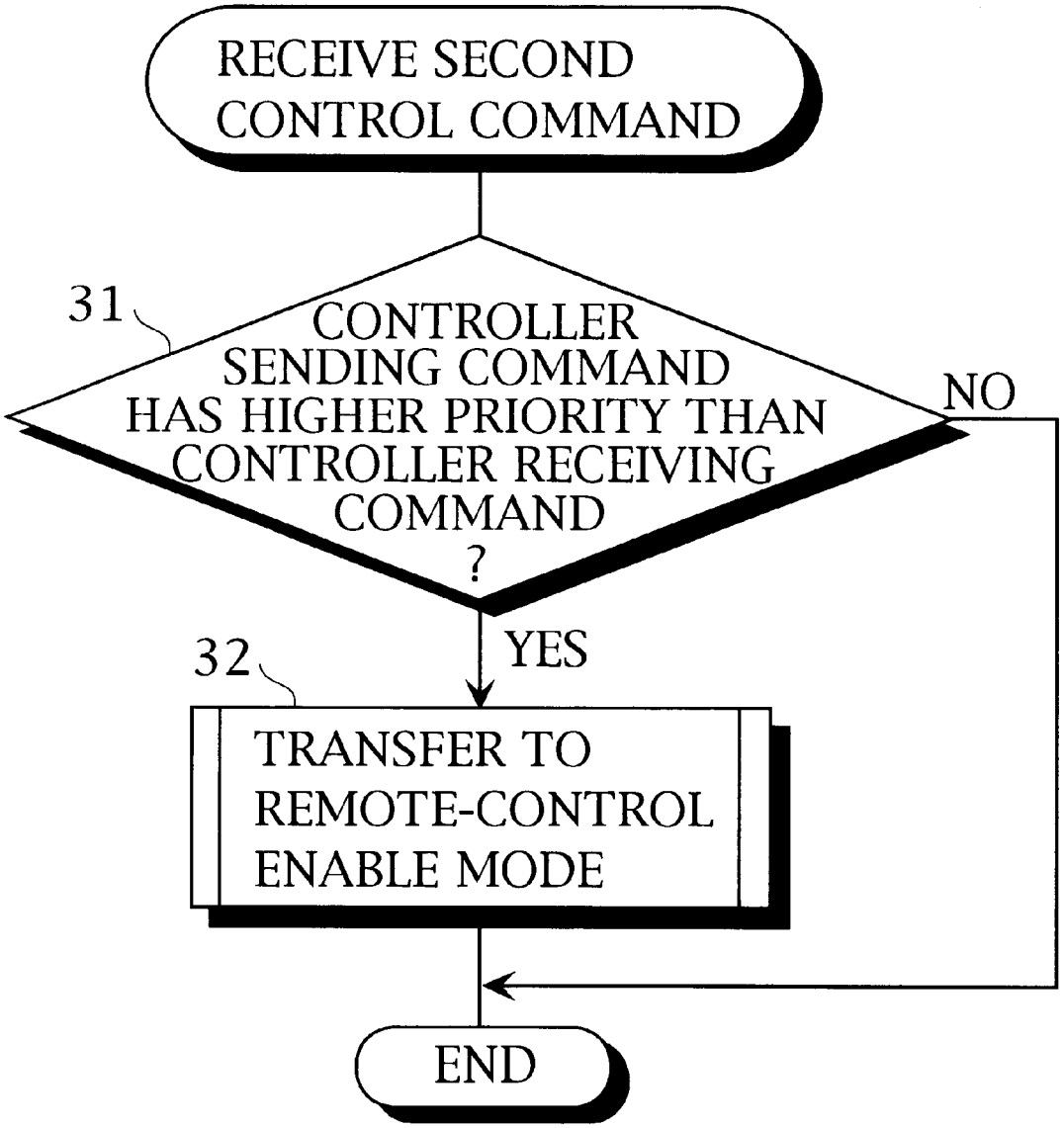
FIG. 5 is a flow chart showing operation steps taken by a controller receiving a second control command from another controller.

FIG. 5 illustrates operation steps taken by a controller receiving a second control command from another controller.

Receiving the second control command, the receive-side controller determines whether the controller sending the second control command is higher in priority than itself or not (Step 31).

If the send-side controller does not have a higher priority than the receive-side controller, the receive-side controller maintains its operation mode as it is.

If the send-side controller has a higher priority than the receive-side controller, the receive-side controller transfers to the remote-control enable mode despite its current operation mode (Step 31).

Accordingly, if the operator manipulates the main controller 11 of the higher priority to set it in the remote-control enable mode, the main controller 11 as well as the subcontroller 12 of the lower priority transfer to the remote-control enable mode.

Figure 6:
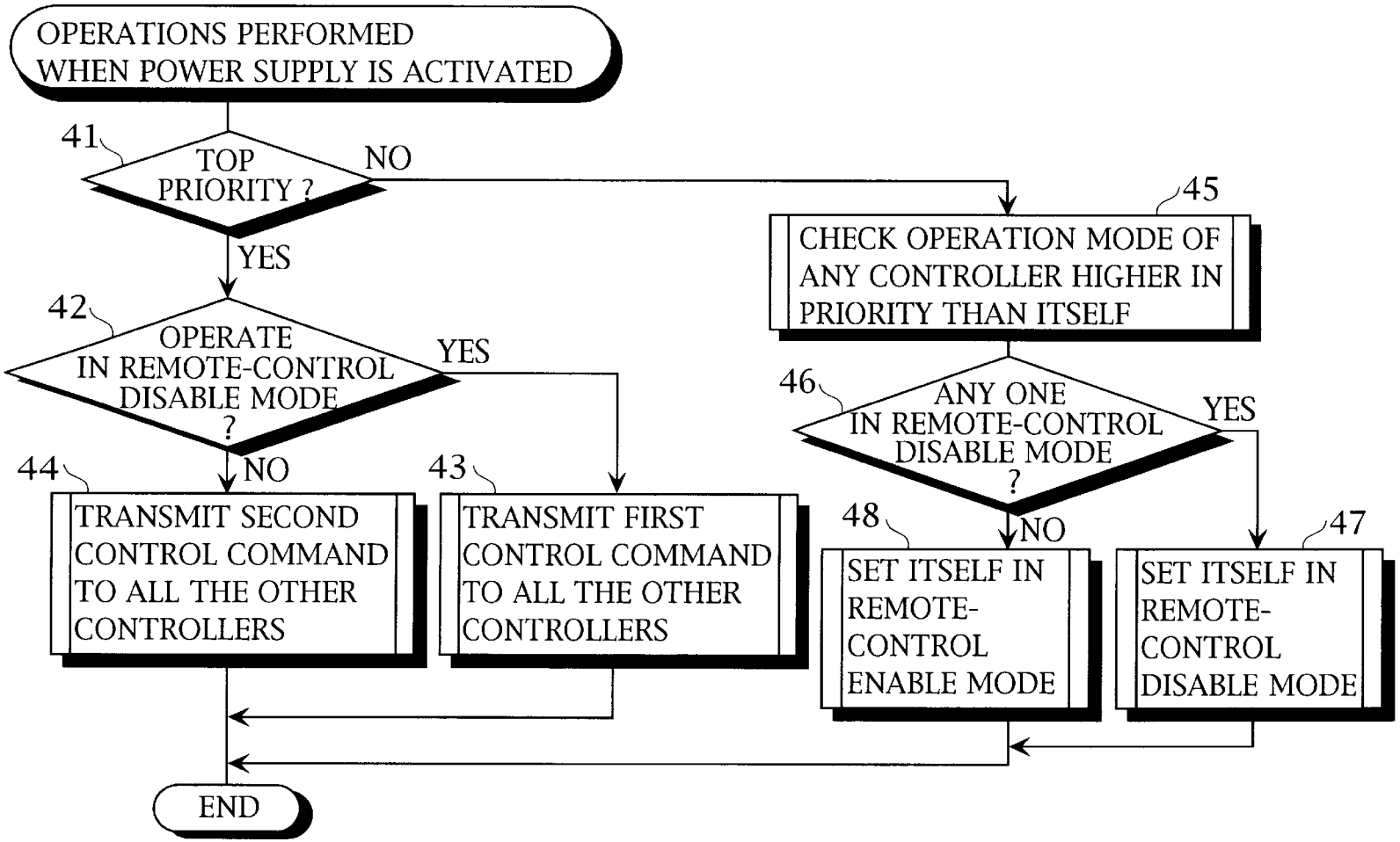
FIG. 6 is a flow chart showing operation steps taken by a controller when its power supply is activated.

FIG. 6 illustrates operation steps taken by a controller when its power supply is activated.

When a power supply for an arbitrary controller is activated, a decision is made as to whether the controller in question is at first place in priority (top priority) or not (Step 41). If the controller in question has the highest priority, a decision is made as to whether the controller operates in the remote-control disable mode or not (Step 42).

If the controller in question is in the remote-control disable mode, it transmits to all the other controllers the first control command containing its priority (Step 43). At receipt of the first control command, the other controllers take the same operation steps as shown in FIG. 3. Thus, the other controllers enter the remote-control disable mode.

If the controller in question is in the remote-control enable mode, it transmits to all the other controllers the second control command containing its priority (Step 44). At receipt of the second control command, the other controllers take the same operation steps as shown in FIG. 5. Thus, the other controllers enter the remote-control enable mode.

If Step 41 determines that the controller in question does not have the top priority, it communicates with controllers higher in priority than itself to check their current operation modes (Step 45). Then, the controller in question determines whether any of the higher priority controllers operates in the remote-control disable mode or not (Step 46).

If any of the higher priority controllers operates in the remote-control disable mode, the controller in question sets itself in the remote-control disable mode (Step 47).

If none of the higher priority controllers operates in the remote-control disable mode, the controller in question sets itself in the remote-control enable mode (Step 48).

Accordingly, when a lower priority controller is energized, the controller in question is set in the remote-control disable mode if any of the controllers higher in priority than the controller in question operates in the remote-control disable mode.

Therefore, in a case where a new controller is added to the system having the main controller of top priority set in the remote-control disable mode, the new controller may be previously assigned a lower priority than the main controller so that the controllable devices are prevented from being remotely controlled through manipulation of the added controller.

What is claimed is:

1. A security lock control method for electronic-device remote control system including electronic devices, one main controller connected to the electronic devices via a bus for remotely controlling the electronic devices, and one or more subcontrollers connected to the electronic devices via the bus for remotely controlling the electronic devices, wherein operation modes of each controller include a remote-control enable mode to enable remote control of all the electronic devices connected to the bus, and a remote-control disable mode to disable the remote control of all the electronic devices connected to the bus, wherein when an operation is performed to set the main controller in the remote-control disable mode, the main controller sets itself in the remote-control disable mode while informing the subcontrollers that the operation mode of the main controller is transferred to the remote-control disable mode, thereby causing the subcontrollers to set themselves in the remote-control disable mode, wherein when an operation is performed to set the main controller in the remote-control enable mode, the main controller sets itself in the remote-control enable mode while informing the subcontrollers that the operation mode of the main controller is transferred to the remote-control enable mode, thereby causing the subcontrollers to set themselves in the remote-control enable mode, wherein when an operation is performed to set any one of the subcontrollers in the remote-control disable mode, the subcontroller sets itself in the remote-control disable mode, and wherein when an operation is performed to set any one of the subcontrollers in the remote-control enable mode, the subcontroller checks the operation mode of the main controller, then setting itself in the remote-control enable mode if the main controller is in the remote-control enable mode or maintaining itself in the remote-control disable mode if the main controller is in the remote-control disable mode.

2. A security lock control method for remote control system as claimed in claim 1, wherein when energized, the main controller informs the subcontrollers of its operation mode thereby establishing coincidence in the operation mode of the subcontrollers and of the main controller, and wherein when energized, any one of the subcontrollers checks the operation mode of the main controller for establishing coincidence in the operation mode of the subcontroller and the main controller.

3. A security lock control method for remote control system including electronic devices and a plurality of controllers connected to the electronic devices via a bus for remotely controlling the electronic devices, wherein each of the controllers is previously assigned a priority and has operation modes including a remote-control enable mode to enable remote control of all the electronic devices connected to the bus and a remote-control disable mode to disable the remote control of all the electronic devices connected to the bus, wherein when an operation is performed to set any one of the controllers in the remote-control disable mode, the controller in question sets itself in the remote-control disable mode while transmitting to the other controllers a first control command containing a priority thereof, wherein a controller receiving the first control command sets itself in the remote-control disable mode if the priority contained in the first control command is higher than a priority thereof, wherein when an operation is performed to set a top priority controller in the remote-control enable mode, the top priority controller sets itself in the remote-control enable mode while transmitting to the other controllers a second control command containing the priority thereof, wherein when an operation is performed to set any one of the controllers other than the top priority controller in the remote-control enable mode, the controller in question checks the operation mode of any controller higher in priority than itself, then setting itself in the remote-control enable mode and transmitting to the other controllers a second control command containing the priority thereof if the higher priority controller is in the remote-control enable mode, or maintaining itself in the remote-control disable mode if the higher priority controller is in the remote-control disable mode, and wherein a controller, receiving the second control command, sets itself in the remote-control enable mode if the priority contained in the second control command is higher than a priority thereof.

4. A security lock control method for remote control system as claimed in claim 3, wherein if the top priority controller, when energized, is in the remote-control disable mode, the top priority controller transmits to the other controllers the first control command containing the priority thereof, wherein if the top priority controller, when energized, is in the remote-control enable mode, the top priority controller transmits to the other controllers the second control command containing the priority thereof, and wherein, when energized, any one of the controllers other than the top priority controller determines whether any one of controllers higher in priority than itself operates in the remote-control disable mode or not, then setting itself in the remote-control disable mode if any of the higher priority controllers is in the remote-control disable mode or setting itself in the remote-control enable mode if none of the higher priority controllers is in the remote-control disable mode.

* * * * *